US011302158B2

(12) United States Patent
Mansfeld et al.

(10) Patent No.: US 11,302,158 B2
(45) Date of Patent: Apr. 12, 2022

(54) APPARATUS AND METHOD FOR TESTING A GLASS BREAK DETECTION SYSTEM

(71) Applicant: Carrier Corporation, Palm Beach Gardens, FL (US)

(72) Inventors: Sebastian Mansfeld, Palm Beach Gardens, FL (US); Pawel Szczepanski, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/252,763

(22) PCT Filed: Dec. 13, 2019

(86) PCT No.: PCT/US2019/066205

§ 371 (c)(1),
(2) Date: Dec. 16, 2020

(87) PCT Pub. No.: WO2020/123927

PCT Pub. Date: Jun. 18, 2020

(65) Prior Publication Data

US 2021/0264753 A1 Aug. 26, 2021

(30) Foreign Application Priority Data

Dec. 14, 2018 (EP) ..... 18461642

(51) Int. Cl.
*G08B 13/04* (2006.01)
*G08B 29/14* (2006.01)

(52) U.S. Cl.
CPC ..... *G08B 13/04* (2013.01); *G08B 29/14* (2013.01)

(58) Field of Classification Search
CPC .... G08B 13/04; G08B 29/14; G08B 13/1672; G08B 29/22; G08B 19/005
See application file for complete search history.

(56) References Cited

U.S. PATENT DOCUMENTS 5,164,703 A * 11/1992 Rickman ..... G08B 29/14 340/514
2012/0092163 A1* 4/2012 Hart ..... G08B 15/02 340/541
2013/0076506 A1 3/2013 Smith et al.
2013/0170323 A1* 7/2013 Smith ..... G08B 13/04 367/197

(Continued)

FOREIGN PATENT DOCUMENTS

AU 2000278920 11/2006
AU 2014337037 4/2016

(Continued)

OTHER PUBLICATIONS

International Preliminary Report on Patentability for Application No. PCT/US2019/066205 dated Jun. 8, 2021.

(Continued)

*Primary Examiner* — Mirza F Alam
(74) *Attorney, Agent, or Firm* — Carlson, Gaksey & Olds, P.C.

(57) ABSTRACT

A glass break detection testing system including a speaker communicatively coupled to a remote device, the remote device being configured to transmit a recorded sound file to the speaker thereby causing the speaker to emit the transmitted sound file.

18 Claims, 1 Drawing Sheet

(56) References Cited

U.S. PATENT DOCUMENTS

| | | | | |
|---|---|---|---|---|
| 2014/0361896 | A1* | 12/2014 | Sibley | G08B 13/08 340/546 |
| 2019/0306640 | A1* | 10/2019 | Liu | G10L 25/90 |

FOREIGN PATENT DOCUMENTS

| | | |
|---|---|---|
| AU | 2016228525 | 10/2017 |
| AU | 2016228529 | 10/2017 |
| AU | 2016331221 | 4/2018 |
| CA | 2411043 | 11/2001 |
| CA | 2689757 | 1/2009 |
| CA | 2645471 | 5/2009 |
| CA | 2762101 | 11/2010 |
| CA | 2946200 | 11/2015 |
| CA | 2946891 | 11/2015 |
| CA | 2949370 | 12/2015 |
| CA | 3002002 | 4/2017 |
| CA | 2950603 | 6/2017 |
| WO | 2001093220 | 12/2001 |

OTHER PUBLICATIONS

International Search Report and Written Opinion for International Patent Application No. PCT/US2019/066205 dated Apr. 7, 2020.

* cited by examiner

APPARATUS AND METHOD FOR TESTING A GLASS BREAK DETECTION SYSTEM

CROSS-REFERENCE TO RELATED APPLICATIONS

This application claims priority to European Patent Application No. 18461642.3, which was filed on Dec. 14, 2018 and is incorporated herein by reference.

TECHNICAL FIELD

The present disclosure relates generally systems and methods for testing a glass break detection system, and more specifically for a system and method for remotely testing a glass break detection system.

BACKGROUND

Security systems, such as home invasion detection systems, building security systems, and the like, frequently include glass break detection systems as some or all of their intrusion detection. A simple glass break detections system includes a microphone positioned within a room. The microphone is communicatively coupled to a main panel. Sounds picked up by the microphone are compared against one or more stored sound patterns to determine if the detected sound pattern is consistent with a glass break sound pattern. When the detected sounds are consistent with a known glass break pattern, a glass break is detected and the security system reacts accordingly.

In order to test whether a glass break detection system is functional, current state of the art testing schemes utilize a maintenance technician standing in the room with a testing device. The testing device plays back a limited number of prerecorded glass break sounds, and the main panel is monitored to determine if a glass break sound is detected.

SUMMARY OF THE INVENTION

In one exemplary embodiment a glass break detection testing system includes a speaker communicatively coupled to a remote device, the remote device being configured to transmit a recorded sound file to the speaker thereby causing the speaker to emit the transmitted sound file.

In another example of the above described glass break detection system the remote device is exterior to a room including the speaker, and wherein the remote device is connected to the speaker via one of a local wireless communication protocol and a hardwired network.

In another example of any of the above described glass break detection systems the speaker is temporarily connected to a window via a suction cup.

In another example of any of the above described glass break detection systems the speaker is permanently affixed proximate a window.

In another example of any of the above described glass break detection systems the remote device is connected to one of a sensor within a room and a security system connected to the sensor within the room, such that the remote device is capable of monitoring a reaction of the one of the sensor and the security system.

In another example of any of the above described glass break detection systems the remote device is connected to the security system through a cloud based network.

In another example of any of the above described glass break detection systems the remote device is directly connected to the sensor via one of a local wireless connection and a hardwires connection.

In another example of any of the above described glass break detection systems the sensor includes a microphone.

In another example of any of the above described glass break detection systems the speaker includes a processor and a memory, and wherein the memory is configured to receive and retain at least one recorded sound filed from the remote device.

In another example of any of the above described glass break detection systems the remote device includes a memory storing instructions configured to cause the remote device to provide a sound file to the speaker, and monitor a corresponding one of a security system and a sensor, thereby determining if a functionality of the corresponding one of the security system and the sensor.

An exemplary method for testing a glass break detection system includes transmitting a sound file from a first device to a speaker disposed within a room, playing the sound file using the speaker, comparing a sound detected by a sensor within the room with a predetermined set of glass break patterns, and determining that the glass break detection system is functional when the comparison indicates a match.

In another example of the above described method for testing a glass break detection system transmitting the sound from the first device to the speaker includes selecting at least one glass break recording from a set of glass break recordings using a remote device exterior to the room, and transmitting the selected at least one glass break recording to the speaker.

In another example of any of the above described methods for testing a glass break detection system the set of glass break recordings is stored on the remote device.

In another example of any of the above described methods for testing a glass break detection system the set of glass break recordings is stored on one of a second device and a cloud network connected to the remote device and the speaker.

Another example of any of the above described methods for testing a glass break detection system further includes updating the set of glass break recordings by providing at least one new glass break recording to the one of the second device and the cloud network.

In another example of any of the above described methods for testing a glass break detection system comparing the sound detected by the sensor within the room with the predetermined set of glass break patterns is performed by a main security system, and wherein the first device is communicatively coupled to the main security system.

In another example of any of the above described methods for testing a glass break detection system comparing the sound detected by the sensor within the room with the predetermined set of glass break patterns is performed by the first device, and wherein the first device is communicatively coupled to the sensor.

These and other features of the present invention can be best understood from the following specification and drawings, the following of which is a brief description.

DETAILED DESCRIPTION

Current state of the art glass break testers are operated manually within a room or zone being tested by the operator holding a tester in a predetermined position and playing one or more prerecorded glass break sounds. The tester can be held by the window(s) in the room, but the positioning of the tester and/or the operator can influence the test, and the operator cannot determine if the test is successful without leaving and reentering the room. As a result, the tests are not repeatable with the exact same conditions.

Some alternate state of the art intrusion detection systems and/or glass break detection testers require that the tester be positioned immediately adjacent to, or near, the microphone sensor. Such systems do not reflect the audio characteristics and acoustics of the room layout, and of any physical barriers such as furniture, walls, partial walls, decorations, etc. that may be positioned between the window and the sensor and may impact the ability of the sensor to detect glass breaking.

Further limiting current state of the art glass break testers is the inclusion of a limited number of example glass break sounds within the tester, relative to the variety of available glass types. By way of example, a typical tester will only have one to two breaking glass recordings present, but substantially more glass types are on the market and can be used, with each type having a unique sound characteristic when it breaks. Further, as new glass types and configurations are developed, the inadequacy of existing glass break testers in this area is exacerbated.

Figure 1:
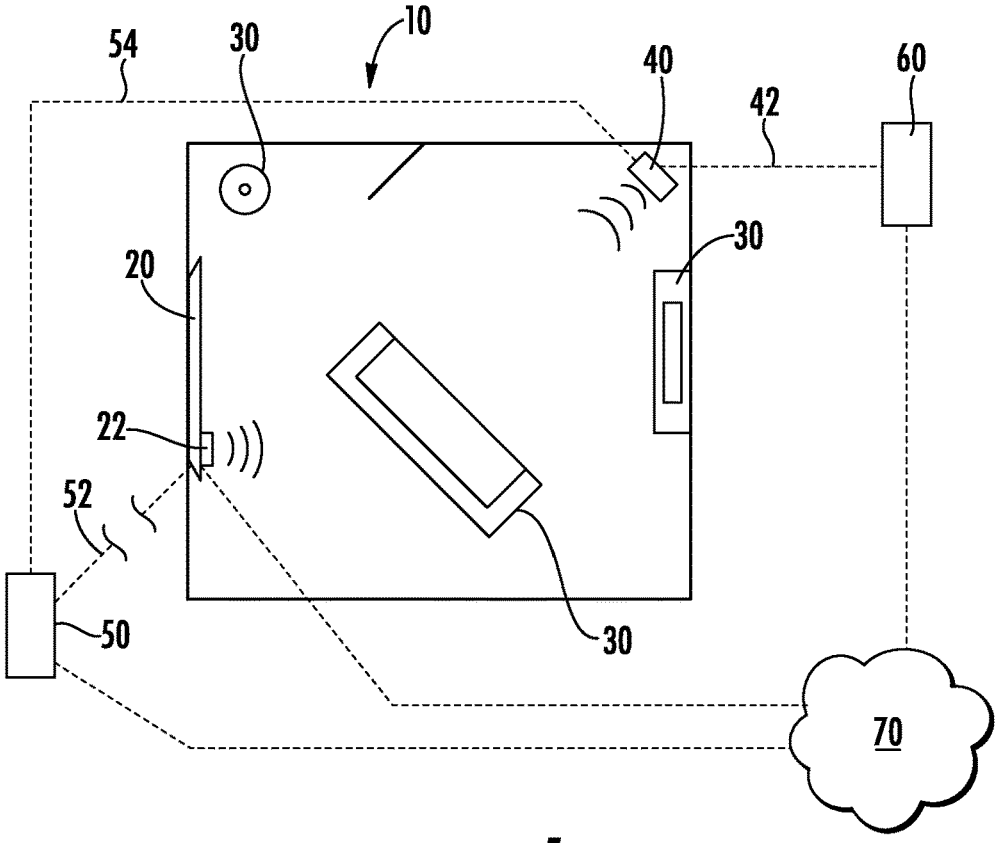
FIG. 1 illustrates an exemplary glass break detection system within a room.

FIG. 1 schematically illustrates a room 10 including a glass break detection system with remote testing capabilities. The room 10 includes a window 20 with a remote controlled speaker 22 attached to the window. The remote controlled speaker 22 can be permanently attached via a fixture to the window frame, or temporarily attached to the window 20 via any form of temporary mechanical connection. The remote controlled speaker can include a memory and a processor, with the memory being configured to receive and retain at least one prerecorded sound file and includes instructions for playing the prerecorded sound file using the processor and the speaker 22.

In one example, the temporary attachment can include a suction cup configured to attach the remote speaker 22 to a smooth surface, such as window glass. Disposed about the room 10 are multiple stationary elements 30, such as furniture, decorations, entertainment systems and the like. The stationary elements 30 are large enough to affect the acoustical character of the room, and generally remain in the same approximate position after all individuals have left the room 10.

A sensor 40, such as a microphone, is disposed in one corner of the room 10, remote from the window 20. The location of the sensor 40 can vary, and can be determined based on easily concealable locations, a position minimizing a distance to each of multiple windows 20, or based on any other numbers of factors including ease of wiring.

The sensor 40 is connected via a communication line 42 to a main security panel 60. In some examples the main security panel 60 is a fully self-contained security system including all computer programing required to operate the security systems. In alternative examples, the panel 60 is connected to a network 70, such as a cloud network through the internet, and all or some of the security operations are managed through the cloud according to any known security system protocol.

Also connected to the network 70 is a mobile device 50, or other remote testing apparatus. The mobile device 50 includes computer software configured to use a local wireless connection 52 to communicate with the speaker 22 from outside the room 10 through one or more walls, ceilings or floors. The local wireless connection 52 can be any form or protocol of local wireless connection 52. By connecting the mobile device 50 to the speaker 22 using the local wireless connection, a technician can operate the speaker 22 portion of the testing system while the room is empty of all people, including the technician. This allows the sensor 40 to be tested in actual conditions that would be present were an intruder to break the glass and try entering, as well as allowing the specific testing conditions of any given test to be repeatable.

In some examples, the mobile device 50 can include a direct communicative connection 54 to the sensor 40. Inclusion of the direct connection 54 can allow the mobile device 50 to fully perform the test, including comparing the sound received at the sensor 40 to the sound played by the speaker 22 using the mobile device 50, without requiring a connection to the main panel 60, or to the network 70.

In yet further examples, such as those where the speaker 22 is permanently mounted in a single position and connected to the network 70, the testing system incorporated in the room 10 can allow for operation of remote tests through the network 70. In such an examples, the mobile device 50 can be replaced with a desktop, or other computing system, located at an offsite location. When a user requests confirmation that the glass break detector (sensor 40) is functional, an operator of the device 50 can, from the remote location, command the test occur.

By way of example, such a test may be desired after the stationary elements 30 within the room have been rearranged, after new stationary elements 30 have been added, previously present stationary elements 30 have been removed, the window 20 has been updated with a different style, or type of glass, or any other change has occurred that could affect the acoustics of the room 10.

Figure 2:
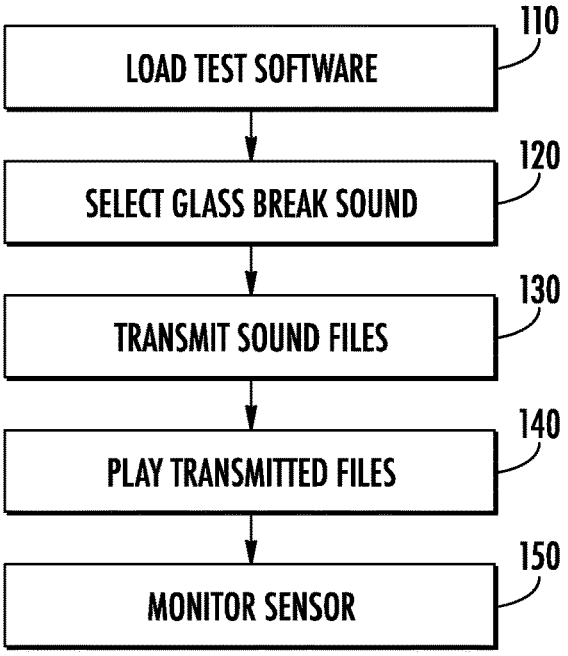
FIG. 2 schematically illustrates a method for operating the remote glass break detection test using the system of FIG. 1.

With continued reference to FIG. 1 FIG. 2 schematically illustrates an exemplary process for operating a glass break test using the system incorporated in the room 10 of FIG. 1.

Initially, an operator loads a testing application on the mobile device 50, or other system, in a "Load Test Software" step 110. As part of loading the test software, the mobile device 50 ensures a communicative connection with the sensor 40, either via the direct connection 54, or indirectly through the network 70 and the main panel 60. Once the connection is verified, and operation of the sensor 40 is confirmed, the mobile device 50 enables the operator to begin the test.

During the initial stage of the test, the operator selects one or more glass break sound from a list of glass break sounds contained within the mobile device 50, or in the security system connected to the mobile device 50 via the network 70, in a "Select Glass Break Sound" step 120. Once selected, the file for the glass break sound is transmitted to the speaker 22 in a "Transmit Sound File" step 130. By storing the sound files either on the mobile device 50 or in the cloud connected to the network 70, and transmitting the sound to the speaker 22, substantially larger numbers of available glass breaking sounds can be used with the testing system. Further, by hosting the sounds in the cloud and connecting to the cloud through the network 70, the glass break sounds can be remotely updated to reflect new glass types, new window configurations, or any similar changes in the window 20 structure that could alter the sound characteristics of glass breaking.

Once the sound file has been transmitted to the speaker 22, the speaker 22 plays the glass break sound in a "Play Transmitted Sound" step 140. Simultaneous with, and shortly following, the playing of the transmitted sound the system monitors the sensor 40 and the main security panel 60 to determine if a glass break detection occurs in a "Monitor Sensor" step 150, without requiring manual changes to the tester.

If the system detects glass breaking in response to the speaker 22 playing the glass break sound, the operator knows that the system is calibrated correctly and is functional. If no glass break detection occurs, then the operator can evaluate the conditions, repeat the test, or otherwise troubleshoot the system.

By utilizing the system and methods described at FIGS. 1 and 2, the glass break detection system can be remotely tested, without requiring any modification to the sensors, or physical structures of the security system. Further, the utilization of network stored files and software applications allows for the testing to be updated to accommodate new technologies, new sensors and the like. The testing conditions (e.g. empty room, with immobile stationary elements) can be repeatable and can accurately reflect the conditions of the room when a glass break detection is necessary. In addition to the above, the ability of the speaker 22 to be connected directly to the network 70 allows for substantially remote operation and upgrade of the testing system.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A glass break detection testing system comprising:

a speaker disposed in a room empty of all people and communicatively coupled to a remote device exterior to the room including the speaker, the remote device being configured to transmit a recorded sound file to the speaker thereby causing the speaker to emit the transmitted sound file, wherein the recorded sound file comprises a recording of breaking glass, and wherein the controller stores instructions configured to cause the glass break detection system to compare a sound detected by a sensor within the room with a predetermined set of glass break patterns.

2. The glass break detection testing system of claim 1, wherein the remote device is connected to the speaker via one of a local wireless communication protocol and a hardwired network.

3. The glass break detection system of claim 1, wherein the speaker is temporarily connected to a window via a suction cup.

4. The glass break detection system of claim 1, wherein the speaker is permanently affixed proximate a window.

5. The glass break detection system of claim 1, wherein the remote device is connected to one of a sensor within the room and a security system connected to the sensor within the room, such that the remote device is capable of monitoring a reaction of the one of the sensor and the security system.

6. The glass break detection system of claim 5, wherein the remote device is connected to the security system through a cloud based network.

7. The glass break detection system of claim 5, wherein the remote device is directly connected to the sensor via one of a local wireless connection and a hardwires connection.

8. The glass break detection system of claim 5, wherein the sensor includes a microphone.

9. The glass break detection system of claim 1, wherein the speaker includes a processor and a memory, and wherein the memory is configured to receive and retain at least one recorded sound filed from the remote device.

10. The glass break detection system of claim 1, wherein the remote device includes a memory storing instructions configured to cause the remote device to provide a sound file to the speaker, and monitor a corresponding one of a security system and a sensor, thereby determining if a functionality of the corresponding one of the security system and the sensor.

11. A method for testing a glass break detection system comprising:

transmitting a sound file from a first device exterior to a room to a speaker disposed within the room, the room being empty of all people;

playing the sound file using the speaker;

comparing a sound detected by a sensor within the room with a predetermined set of glass break patterns using a controller; and determining that the glass break detection system is functional when the comparison indicates a match.

12. The method of claim 11, wherein transmitting the sound from the first device to the speaker includes selecting at least one glass break recording from a set of glass break recordings using a remote device exterior to the room, and transmitting the selected at least one glass break recording to the speaker.

13. The method of claim 12, wherein the set of glass break recordings is stored on the remote device.

14. The method of claim 12, wherein the set of glass break recordings is stored on one of a second device and a cloud network connected to the remote device and the speaker.

15. The method of claim 14, further comprising updating the set of glass break recordings by providing at least one new glass break recording to the one of the second device and the cloud network.

16. The method of claim 11, wherein comparing the sound detected by the sensor within the room with the predetermined set of glass break patterns is performed by a main security system, and wherein the first device is communicatively coupled to the main security system.

17. The method of claim 11, wherein comparing the sound detected by the sensor within the room with the predetermined set of glass break patterns is performed by the first device, and wherein the first device is communicatively coupled to the sensor.

18. The glass break detection system of claim 1, wherein the stored instructions are further configured to cause the controller to determine that the glass break detection system is functional when the sound detected by the sensor match at least one glass break pattern in the set of glass break patterns.

* * * * *